United States Patent [19]

Pacheco

[11] Patent Number: 4,761,964

[45] Date of Patent: Aug. 9, 1988

[54] APPARATUS FOR ENHANCING THE PERFORMANCE OF A HEAT PUMP AND THE LIKE

[76] Inventor: Jerry J. Pacheco, 24659 Brook Dr., Madera, Calif. 93638

[21] Appl. No.: 138,715

[22] Filed: Dec. 28, 1987

Related U.S. Application Data

[63] Continuation-in-part of Ser. No. 921,612, Oct. 22, 1986, abandoned.

[51] Int. Cl.[4] ..... F25B 13/00

[52] U.S. Cl. ..... 62/160; 62/238.6; 62/324.1; 62/324.4; 165/29

[58] Field of Search ..... 165/29, 64; 62/160, 62/324.1, 324.4, 503, 238.6

[56] References Cited

U.S. PATENT DOCUMENTS

| | | | |
|---|---|---|---|
| 3,135,317 | 6/1964 | Goettl | 165/17 |
| 3,189,085 | 6/1965 | Eberhart | 165/12 |
| 3,529,659 | 9/1970 | Trask | 62/160 X |
| 3,918,268 | 11/1975 | Nussbaum | 62/160 X |
| 4,112,705 | 9/1978 | Sisk et al. | 62/238 |
| 4,373,346 | 2/1983 | Hebert et al. | 62/160 X |
| 4,420,034 | 12/1983 | Vandervaart | 165/29 |
| 4,429,734 | 2/1984 | Vandervaart | 165/29 |
| 4,441,546 | 4/1984 | Vandervaart | 165/29 |
| 4,441,901 | 4/1984 | Endoh | 62/160 |
| 4,457,137 | 7/1984 | Kohzuma | 62/160 X |
| 4,458,665 | 7/1984 | Vandervaart | 126/101 |
| 4,506,521 | 3/1985 | Asano et al. | 62/324.1 |

OTHER PUBLICATIONS

McGraw-Hill Encyclopedia of Science and Technology, vol. 6, copyright, 1971 by McGraw Hill, Inc., pp. 417 through 419.

*Primary Examiner*—Lloyd L. King
*Attorney, Agent, or Firm*—Worrel & Worrel

[57] ABSTRACT

Apparatus for enhancing the performance of a heat pump which includes first and second auxiliary coils that are operatively connected to the heat pump. Each auxiliary coil has a radiant quartz heating element disposed internally thereof and a fan is disposed in closely adjacent spaced relation to the second auxiliary coil and exteriorly thereof. A pair of thermostats selectively actuate the radiant quartz heating elements and the fan at preselected environmental ambient temperatures to achieve increased heat pump efficiency.

16 Claims, 4 Drawing Sheets

APPARATUS FOR ENHANCING THE PERFORMANCE OF A HEAT PUMP AND THE LIKE

This application is a continuation-in-part of application Ser. No. 06/921,612 filed on Oct. 22, 1986, now abandoned.

BACKGROUND OF THE INVENTION

1. Field of the Invention

The present invention relates to an apparatus for enhancing the performance of a heat pump and the like, and more particularly to such an apparatus that is relatively inexpensive to construct and maintain, and which is economical to operate, the apparatus increasing the operating efficiency of the heat pump over a wider range of environmental ambient temperature conditions.

2. Description of the Prior Art

Heat pumps in various configurations, capacities, and other operational characteristics have been known and utilized for many years. It is well known that a heat pump operates by raising the temperature level of heat by means of work input. In its most common configuration, a compressor takes refrigerant vapor from a low pressure, low temperature evaporator and delivers it at high pressure and temperature to a condenser. As a general matter, the pump cycle is identical with that of the customary vapor-compression refrigeration system.

Recently, heat pumps have found increasing acceptance when operated in combination with solar heating systems. This union of solar heating systems and heat pumps is attractive because the efficiency of a solar collector rises rapidly with lower collection temperatures such that an electrically driven heat pump can utilize the solar heat source with a resulting higher overall coefficient of performance.

It should be understood, however, that heat pumps, in and of themselves, have not come into wide usage for the comfort heating or cooling of living spaces because their effectiveness over a range of outside ambient temperatures is quite limited. As a general matter, it is well understood that the heat which can be delivered by a heat pump decreases significantly as the outside ambient temperature descends below 36° Fahrenheit and becomes zero when the outside temperature reaches approximately 28° Fahrenheit. Moreover, it is well known that when the outside ambient temperature rises above 78° Fahrenheit there is the presence of excess heat which correspondingly decreases the cooling capacity of the heat pump. As should be understood, sundry devices and systems are offered to correct this situation such as storage systems, supplementary heaters and compressors operating alternatively in series or in parallel.

The prior art apparatuses which have been designed to address the problem of the limited temperature range and effectiveness of a heat pump have met with varying degrees of success, but they have also suffered from numerous shortcomings. One of the major shortcomings is that the cost of operating these numerous supplementary devices is substantial. Moreover, it is frequently the case that these supplementary devices are in themselves expensive, and therefore cost prohibitive. As a consequence, heat pumps have not been used extensively for comfort control in homes, business or the like.

Still another significant problem with the prior art devices is that they are not as versatile as desired in many operational environments and are not as readily adaptable to onsite conditions, as is normally encountered. It should be understood that the various manufacturers of heat pumps have developed sundry different designs and configurations and therefore supplementary devices are often difficult to install and thereafter operate. This problem can be particularly acute in residential installations where only limited space is available.

Similarly, the prior art supplementary devices once installed are difficult to remove or disassemble for maintenance and the like.

Therefore, it has long been known that it would be desirable to have an apparatus for enhancing the performance of a heat pump and the like which is adapted for installation on a wide variety of different models of heat pumps and which can, in some instances, be adapted on-site during such installation; and which operates cooperatively with the heat pump to achieve increased heat pump efficiency over a wider range of outside ambient air temperatures; which is readily removable for maintenance after installation; and which can be manufactured, installed and operated at a relatively nominal price.

SUMMARY OF THE INVENTION

Therefore, it is an object of the present invention to provide an improved apparatus for enhancing the performance of a heat pump and the like.

Another object is to provide such an apparatus which preheats, or cools a refrigerant before it enters an associated compressor to increase the operating temperature range of the heat pump and thus increase its operational efficiency.

Another object is to provide such an apparatus which is readily adaptable to most all models and designs of commercially available heat pumps.

Another object is to provide such an apparatus which is characterized by ease of installation, simplicity of construction, and which can be sold and installed at relatively nominal expense.

Further objects and advantages are to provide improved elements and arrangements thereof in an apparatus for the purposes described which is dependable, economical, durable and fully effective in accomplishing its intended purposes.

These and other objectives and advantages are achieved in the apparatus for enhancing the performance of a heat pump with which it is utilized and wherein a pair of auxiliary coils are operatively connected to the heat pump and receive the refrigerant which is circulated by the heat pump; a quartz heater is disposed in heat transferring relation to each auxiliary coil; a fan is disposed in heat removal relation to one of the auxiliary coils; and a pair of thermostats selectively actuates the quartz heating elements, and the fan, at predetermined outside ambient air temperatures, and predetermined refrigerant temperatures, to enhance the heat pumps operational efficiency.

DESCRIPTION OF THE PREFERRED EMBODIMENT

Figure 2:
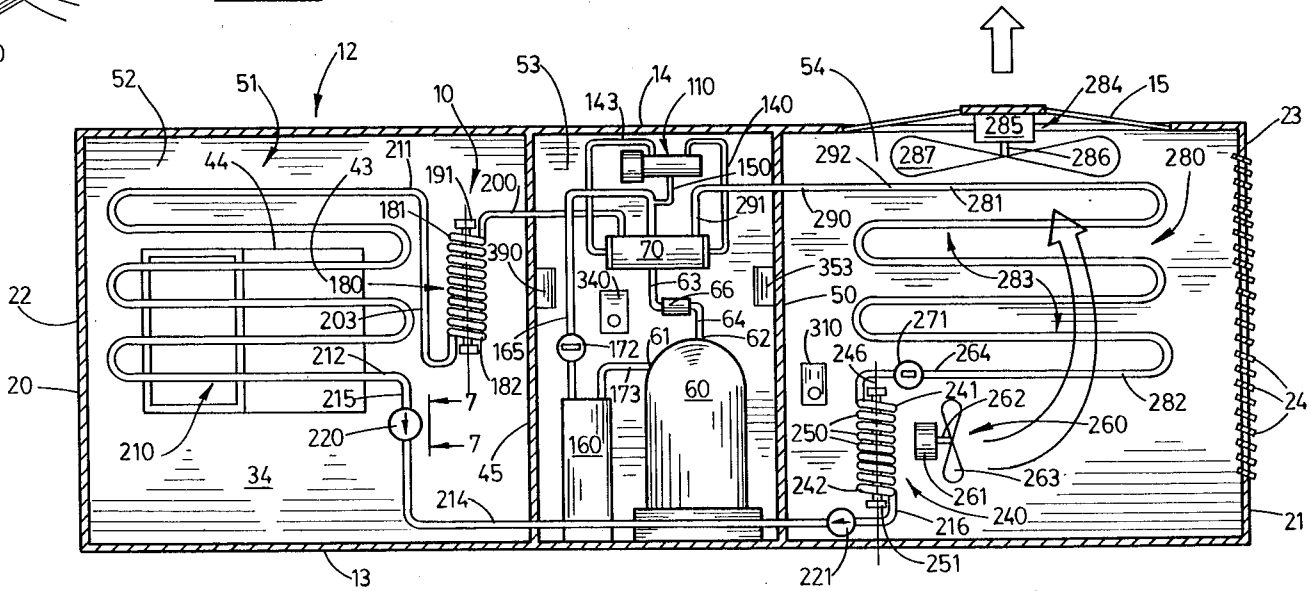
FIG. 2 is a somewhat enlarged, longitudinal vertical section taken along line 2—2 of FIG. 1.

Referring more particularly to the drawings, the apparatus for enhancing the performance of a heat pump of the present invention is generally indicated by the numeral 10 in FIG. 2. For illustrative convenience the apparatus is shown and described herein as it would be installed on, or retrofitted to, a heat pump 11. The heat pump 11 is of a conventional residential design well known to those skilled in the art. Its operation is similar to that of the compression refrigerator. It has the same major components including a compressor, condensing coil and evaporating coil. However, whereas the refrigerator extracts heat from a chamber by the evaporation of refrigerant and thereby lowers the temperature, the heat pump can individually perform both the acts of supplying heat and removing heat from a service area (not shown). The compressor, condensing coil and evaporating coil will later be discussed in greater detail. The heat pump will supply or remove heat from a service area depending upon the selective adjustment of a four-way valve which is also familiar to those skilled in the art.

The selective adjustment and operation of a four-way valve is also discussed in greater detail hereinafter. The phenomenon utilized for this purpose is that fluids which are under high pressure evaporate at a higher temperature than fluids under lower pressure. Thus, when a fluid condenses it gives off heat energy. In the heat pump, the fluid transfer medium, or refrigerant, typically freon, is evaporated at low pressure in the evaporating coil. The work of transporting the refrigerant from low to high pressure is done by the compressor which draws in the refrigerant and compresses it to a desired high pressure. Once this event has occurred, the high pressure, high temperature refrigerant moves to the condensing coil where it condenses at the higher pressure and gives off heat. By means of this cycle, the refrigerant within the heat pump is "pumped up" from a low temperature to a high temperature, the necessary work being done by the compressor. A heat pump can, of course, be used in either the cooling or heating mode upon the adjustment of the four-way reversing valve.

Figure 7:
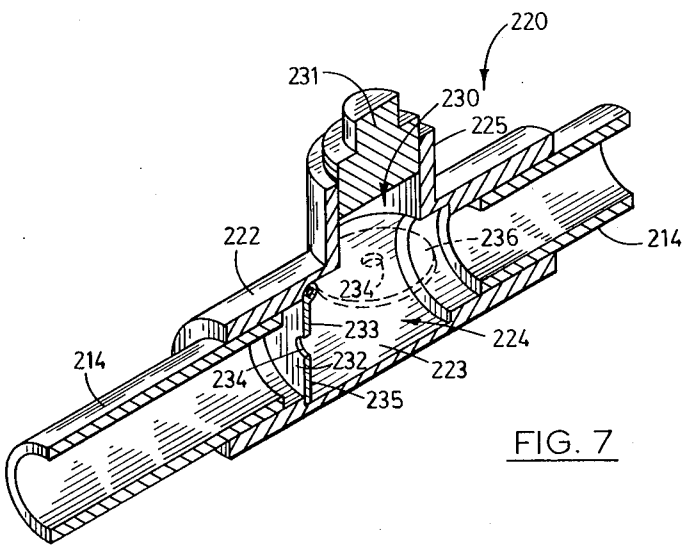
FIG. 7 is a somewhat enlarged, longitudinal section shown in perspective of a metering check valve and taken along line 7—7 of FIG. 2.
Figure 1:
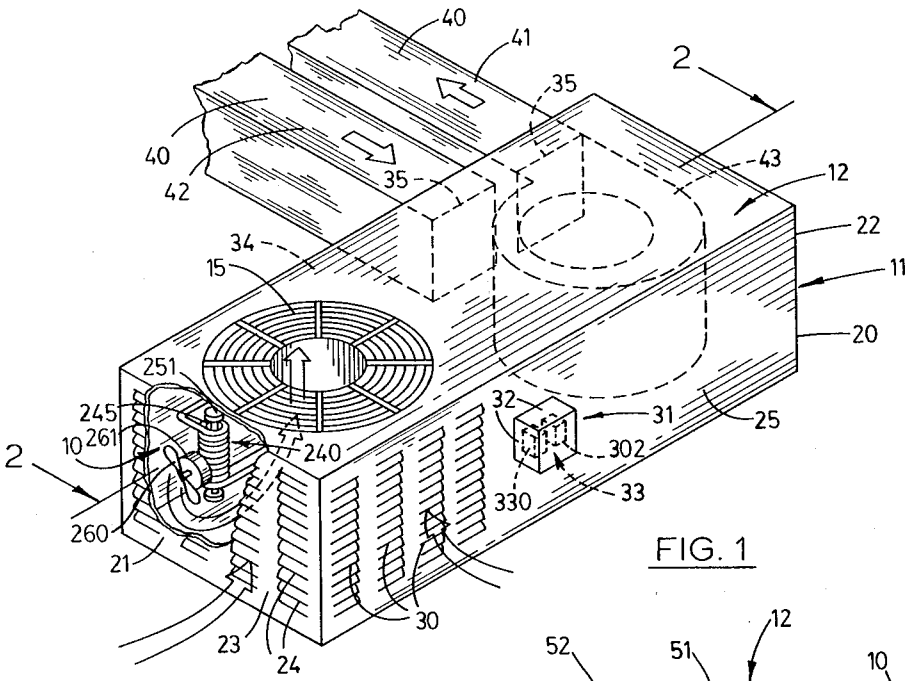
FIG. 1 is a fragmentary perspective view of the apparatus for enhancing the performance of a heat pump and the like of the present invention shown in a typical operative configuration installed internally of a heat pump of conventional design, one of the exterior surfaces of which has been removed to show the structure thereunder.

The heat pump 11 is enclosed or sheltered in a housing 12, which has a bottom surface 13, and a top surface 14, which has a fan port 15 formed therein. The housing 12 further has a first end 20, a second end 21, and a pair of end walls 22 and 23, respectively. The end wall 23 has a plurality of vents 24 formed therein, and the end walls are joined together by a front wall 25. A plurality of vents 30 are formed in the front wall in an area closely adjacent to the second end 21 of the housing. A second housing 31 is mounted to the front wall 25 of the housing 11. The second housing, which is defined by a plurality of side walls 32, defines a cavity 33 which is adapted to shelter a pair of thermostats, which are adapted to sense the environmental ambient air temperature. The thermostats will hereinafter be discussed in greater detail. The end walls further are joined together by a rear wall 34 which has a pair of rectangularly shaped orifices 35 formed therein. The orifices 35 are adapted individually to receive, in sealingly mating relation, a pair of air ducts 40. An exhaust or supply air duct 41 is operable to channel treated air from the heat pump to a service area remote with respect to the heat pump, not shown, and an intake or return air duct 42 is operable to channel air drawn by the heat pump from the service area back into the heat pump. As best illustrated by reference to FIG. 1, a first fan assembly 43, of conventional design, is mounted in the housing 12 and is operable to propel the treated air into, and along, the exhaust air duct 41. The first fan assembly 40 has a housing 44 which is connected in fluid flow relation with the exhaust air duct. A pair of internally disposed support walls, herein indicated as a first and second support wall 45 and 50, respectively, are individually mounted to the top and bottom surface 14 and 13, respectively, of the housing 12 and serve to divide the chamber 51, defined by the housing 12, into three discrete work spaces herein indicated as a first, second, and third space 52, 53, and 54, respectively.

A compressor, which is generally indicated by the numeral 60, is mounted on the bottom surface 13 of the housing 12 and is disposed internally of the second space 53. The compressor which is of well known configuration has an intake port which is designated generally by the numeral 61 and an exhaust port 62. A first conduit 63 is connected in secure fluid transferring relation to the exhaust port 62. The first conduit has a first end 64 which is sealingly mounted to the exhaust port and a second end 65. Disposed in fluid flow relation along the first conduit is a muffler 66. As earlier discussed, the compressor is operable to take the refrigerant gas, not shown, and compress it such that it becomes a high temperature and high pressure gas.

Connected in fluid communication with, and downstream of the compressor 60 is a four-way reversing valve which is generally indicated by the numeral 70. The four-way valve 70 has a cylindrically shaped casing or housing 71. The housing 71 has a substantially cylindrically shaped side wall 72 and a first and second end 73 and 74, respectively. A pair of end walls 75 are mounted at the first and second ends; and the side wall 72 and the end walls 75 define a cylindrically shaped passageway 76 internally of the housing 71. As best seen by reference to FIGS. 5 and 6, a first and second nose valve 80 and 81, respectively, are individually mounted in the end walls 75 at the first and second end 73 and 74 of the housing 71. Furthermore, first, second, third, and fourth ports 82, 83, 84 and 85, respectively, are formed in predetermined positions in the side wall 72. A slide or piston, which is generally indicated by the numeral 90, is conformably dimensioned for sliding mating receipt internally of the passageway 76. The slide 90 has a first and second end 91 and 92, respectively, which mounts a cap or projection 93 that is operable sealingly to mate with the respective nose valves 80 or 81 thereby impeding the flow of refrigerant therethrough.

The slide 90 has a longitudinal axis that is indicated by the line labeled 94; and a first and second longitudinally disposed channel 95 and 100, respectively, is formed into the slide 90. As best seen by reference to FIG. 6, a first and second transversely disposed channel 101 and 102 are formed into the slide 90 and disposed in close proximity to the first and second end thereof. The transversely disposed channels are connected in fluid transferring relation with the first longitudinally disposed channel 95. As best understood by reference to FIGS. 5 and 6, the slide 90 is adapted to move between a first position 103, wherein the slide 90 seals the second nose valve 81, and a second position 104 where it seals the first nose valve 80.

A solenoid pilot valve, which is generally indicated by the numeral 110, is connected in fluid communication with the four-way valve 70. The pilot valve 110 is further electrically connected to a remote thermostat, not shown, which is positioned in the space to be conditioned, and which is adapted to actuate the pilot valve in a manner which will hereinafter be discussed in greater detail. The pilot valve has an elongated main housing 111, the housing 111 having first and second ends 112 and 113, respectively. The housing 111 further has a side wall 114, and a pair of spaced apart end walls 115 which define a cylindrically shaped channel or cavity 120. The side wall 114 of the housing 111 has first, second, and third ports 121, 122 and 123, respectively formed therein. The ports are individually operable sealingly to engage various conduits which will hereinafter be discussed in greater detail. As best illustrated by reference to FIGS. 5 and 6, the pilot valve 110 slidably mounts in the channel 120 a slide, or piston 124. The piston 124 is biased in the channel by a helical coil spring, not shown. The piston 124 has a spool shaped main body 125 which has a first, second, and third partition or wall 130, 131, and 132, respectively formed therein. Each partition is conformably dimensioned for sealingly sliding mating receipt internally of the channel, the individual partitions defining a first and second flow area 133 and 134, respectively, around the main body 125 of the piston. The pilot valve and more particularly the piston 124 is operable to move back and forth along the channel 120 from a first or energized position 135 to a second or deenergized position 136. As should be understood, the remote thermostat, not shown, is operable selectively to place the pilot valve in the energized or deenergized position depending upon the preselected heating or cooling requirements of the conditioned space.

A second conduit 140, which is operable to transport the refrigerant, not shown, is disposed in fluid flow communication between the four-way valve 70 and the pilot valve 110. The second conduit has a first end 141 which is mounted in sealingly secure fluid flow relation with the second nose valve 81; and a second end 142 which is secured in fluid flow relation with the third port 123 of the pilot valve. A third conduit for transmitting refrigerant is disposed therebetween the pilot valve 110 and the four-way valve and has a first end 144, which is secured in fluid flow relation with the first nose valve 80; and a second end 145 which is sealingly mounted in fluid flow relation with the second port 122. A fourth conduit 150 for transmitting refrigerant is mounted in fluid-flow communication with the pilot valve, and has a first end 151 which is sealingly mounted in fluid flow relation with the first port 121, and a second end 122. The inter-operation of the pilot valve and fourway valve will hereinafter be discussed in greater detail.

An accumulator which is generally indicated by the numeral 160 is mounted on the bottom surface 13, in the second space 53, of the housing 12. The accumulator is mounted in fluid flow communication with, and downstream of, the four-way valve 70, and upstream of the compressor 60. The accumulator is of well known design having a housing or external container 161 which defines a substantially refrigerant impermeable chamber, or storage area 162. The housing 161 further has an intake port 163, and an exhaust port 164. A fifth conduit 165 is disposed in refrigerant transmitting relation therebetween the four-way valve 70 and the accumulator. The fifth conduit has a first end 170 which is mounted in sealingly secure fluid transmitting relation to the third port 84 of the four-way valve; and a second end 171 which is sealingly mounted internally of the chamber 162. Mounted in temperature sensing relation therealong the fifth conduit is a temperature sensing assembly or capillary tube 172 which is adapted to sense the temperature of the refrigerant coursing through same. A sixth conduit, which is generally indicated by the numeral 173, is disposed in fluid flow relation therebetween the accumulator and the compressor. The sixth conduit has a first end 174 which is sealingly mounted internally of the chamber 162, and a second end 175 which is connected in fluid flow relation with the intake port 61 of the compressor. The accumulator is operable to protect the compressor. As should be understood, during the heating cycle, and at lower outside ambient air temperatures there may be an insufficient temperature differential between the liquid refrigerant and the outside air to "evaporate" all the liquid refrigerant, and the accumulator, which is disposed upstream of the compressor serves to store this "excess" liquid refrigerant thereby protecting the compressor from "slugging" or over dilution of the oil, not shown, in the compressor.

A first auxiliary coil, which is generally indicated by the numeral 180 is connected with, and disposed during the heating cycle, downstream of the compressor 60 and the four-way valve 70. The heating cycle of the heat pump 11 and the relationship of the first auxiliary coil therewith, will hereinafter be discussed in greater detail. The first auxiliary coil, which is of helical configuration, has a first end 181, a second end 182, an outside, or outwardly facing surface 183, and an inside or inwardly facing surface 184. The inside surface 184 defines a lumen 185 of sorts. The first auxiliary coil further has a longitudinal axis generally indicated by the line labeled 186, and a multiplicity of coil twists 190. As best understood by reference to FIGS. 3 and 4, the first auxiliary coil is approximately sixteen inches long and six inches in overall diameter. Ideally, the first auxiliary coil is manufactured of $\frac{5}{8}$" copper tubing and the multiplicity of coil twists 190 has the effect of substantially increasing the surface area of the first auxiliary coil. This increase in surface area as compared with the volume of refrigerant contained in the first auxiliary coil has the overall effect of significantly increasing the efficiency of the heat pump 11 as will hereinafter be explained.

Disposed internally and substantially centrally along the longitudinal axis 186, and in the lumen 185, is a quartz heater 191. The quartz heater, which is of conventional design, has a first and second element 192 and 193, which are joined together both physically and electrically by a ceiling and base mount 194 and 195. As should be understood, a quartz heater gives off a form of radiant energy which efficiently heats solid objects but correspondingly does not effectively heat the ambient air surrounding it. The quartz heater therefore efficiently heats the first auxiliary coil 180 even though the ambient air temperature surrounding the first auxiliary coil is quite cold. A seventh conduit 200 connects in fluid flow relation, the first auxiliary coil 180 with the four-way valve 70. The seventh conduit has a first end 201 which is mounted in sealingly secure fluid flow relation with the second port 83 of the four-way valve; and a second end 202 which is connected in fluid flow relation with the first auxiliary coil at the first end 181 thereof. An eighth conduit 203 has a first end 204 which is connected in fluid flow relation to the second end 182 of the first auxiliary coil, and a second end 205 which is connected in fluid flow relation to an indoor or condensing coil generally indicated by the numeral 210.

The indoor or condensing coil 210, is of conventional design and well known by those skilled in the art. As should be understood, the indoor coil can also function as an evaporating coil in those instances where the heat pump 11 is used to cool the space to be conditioned, not shown. The indoor coil 210 has a first end 211 which is mounted in fluid flow relation with the second end 205 of the eighth conduit, and a second end 212. The indoor coil 210 has a multiplicity of coils 213. A ninth conduit 214, for transporting refrigerant in the heat pump 11, is mounted in fluid flow relation with the indoor coil. The ninth conduit has a first end 215 which is sealingly mounted in fluid flow relation with the second end 212 of the indoor coil, and a second end 216 which is mounted in fluid flow communication with the second auxiliary coil. The second auxiliary coil will hereinafter be discussed in greater detail. Disposed in fluid flow relation therealong the ninth conduit is a pair of metering check valves which are hereinafter indicated as a first metering check valve and a second metering check valve 220 and 221, respectively. Each metering check valve has a substantially T-shaped main body or casing 222. The main body has a side wall 223 which defines a fluid passageway 224. The main body 222 further has a neck portion 225 which defines a second passageway 230. The second passageway is adapted screwthreadably to mount a suitably dimensioned plug 231. Disposed substantially centrally of the passageway 224 is a pivotally mounted gate 232. The gate 232 has a main body 233 which is pivotally affixed to the side wall 223 of the main body 222. The gate has a substantially centrally disposed orifice formed therein, and is operable to move between a first closed or fluid impeding position 235 wherein the gate, and more particularly the orifice, operates as an expansion device, and a second or open position 236 wherein the refrigerant flows substantially unimpeded through the metering check valve. As best understood by reference to FIG. 3, the first metering check valve readily moves to the second or open position when the heat pump 11 is operated in its heating cycle, and the second metering check valve is adapted to move and remain in the first or fluid impeding position during the same cycle. Conversely, and as best understood by reference to FIG. 4, the first metering check valve is adapted to move to, and remain in, the first, or fluid impeding position when the heat pump is operated in its cooling cycle, and the second metering check valve readily moves to the second open position 236 during the same cycle. The free flow of refrigerant through each metering check valve is indicated by the arrows placed on the symbol of the metering check valves in FIGS. 3 and 4. The metering check valves are adapted to operate as an expansion device when the direction of flow of refrigerant is opposite to that of the arrows placed on the respective metering check valve. As should be understood, the gate causes the refrigerant to expand when the refrigerant is forced under pressure through the orifice 234.

A second auxiliary coil, which is generally indicated by the numeral 240, is mounted in the third space 54 of the chamber 51 and connected in fluid flow relation with the indoor coil 210 by the ninth conduit 214. The second auxiliary coil has a first end 241, and a second end 242, which is connected in fluid flow relation with the second end 216 of the ninth conduit. The second auxiliary coil further has an outwardly disposed surface 243, and an inwardly facing or inwardly disposed surface 244 which defines a lumen 245 of sorts. The second auxiliary coil also has a longitudinal axis which is indicated by the line labeled 246, and a multiplicity of coil twists 250. The second auxiliary coil has approximately the same dimensions as the first auxiliary coil 180, and further has the same increased surface area to volume of refrigerant ratio, that was earlier discussed in connection with the first auxiliary coil. A second quartz heater which is generally indicated by the numeral 251, is mounted in the lumen 245 and disposed substantially along the longitudinal axis 246 thereof. The second quartz heater is similar in overall construction with that of the first quartz heater 191, that is, it has first and second elements 252 and 253, respectively, the first and second elements being physically mounted together and electrically connected to each other, in the third space 54, by a ceiling mount 254, and a base mount 255. Mounted internally of the third space 54 and disposed in heat removing relation to the second auxiliary coil 240 is a second fan assembly 260. The second fan assembly includes an electric engine 261 which mounts a shaft 262 that is operable to impart rotational movement to a plurality of fan blades 263 mounted thereon. The blades are of conventional design and are adapted to move or draw air through the second auxiliary coil for purposes of removing heat from the refrigerant coursing therethrough. The operation of the second fan assembly will hereinafter be discussed in greater detail.

A tenth conduit 264 has a first end 265 which is sealingly mounted in fluid flow relation at the first end 241 of the second auxiliary coil 240 and a second end 270. A temperature sensor or capillary tube 271 is disposed in temperature sensing relation therealong the tenth conduit and is operable to sense the temperature of the refrigerant coursing therethrough. An outside, or evaporating coil 280 is mounted in fluid flow relation with the tenth conduit 264. The outside or evaporating coil is of conventional design and has a first end 281, a second end 282, and a multiplicity of coils 283. As should be understood, the outside coil operates as an evaporating coil when the heat pump 11 is operated in the heating cycle. However it will be readily recognized that the outside coil can operate as a condensing coil when the heat pump is operated in a cooling cycle. The heating and cooling cycle will hereinafter be discussed in greater detail. A third fan assembly 284 is disposed in air moving relation with respect to the outside coil 280. The third fan assembly 284 is mounted to the housing 12 in the immediate vicinity of the fan port 15, and is operable selectively to create air movement through the third space 54, this air movement operable to remove heat from the third space which is created when the heat pump 11 is operating in the cooling cycle. The third fan assembly is of conventional design having an engine 285 which is interconnected with a source of electricity and a control apparatus, not shown, and having a rotatably mounted shaft which has a plurality of blades 287 affixed thereto. As best seen by reference to FIGS. 3 and 4, an eleventh conduit is disposed in refrigerant transferring relation therebetween the outside coil 280 and the four-way valve 70. The eleventh conduit has a first end 291 which is sealingly secured in fluid flow relation with the fourth port 85 of the four-way valve, and a second end 292 which is mounted in fluid flow relation to the outside coil at the first end 281 thereof.

A source of 24 volt, and 110 volt power is provided to the heat pump 11 and is generally indicated by the numerals 300 and 301, respectively. A first thermostat 302 of conventional design is mounted to the front wall 25 of the housing 12 in the cavity 33 of the second housing 31. The first thermostat which is adjusted, or otherwise made operable to actuate the second fan assembly 260 when the outside ambient air temperature reaches or exceeds 78° Fahrenheit, thereby causing the second fan assembly to move a predetermined amount of air through the second auxiliary coil 240 to cool the refrigerant coursing therethrough, has a first and second electrical contact 303 and 304, respectively. An electrical conductor 305 connects the first electrical contact 303 with the source of 24 volt power 300. A contact bridge 306 is electrically connected to the first contact and is adapted to move from an electrically open to a closed position as indicated by the phantom lines in FIGS. 3 and 4, the contact bridge moving into electrically conducting relation with the second electrical contact 304. An electrical conductor 307 connects the second electrical contact 304 with a first solenoid mechanism which is generally indicated by the numeral 310, and an electrical conductor 308 further connects the first solenoid mechanism to the source of 24 volt power 300. Electrical conductors 311 and 312, respectively, electrically connect the first solenoid mechanism 310 with a source of 110 volt power 301. As best illustrated by reference to FIGS. 3 and 4, the first solenoid mechanism has a pair of movable contact bridges 313 which are individually electrically connected with a first and second electrical contact 314 and 315, respectively. The first solenoid further has a third and fourth electrical contact 316 and 317, respectively. The pair of contact bridges 313 are operable to move together from an electrically open state to an electrically closed state thereby electrically connecting the first and third electrical contacts, and the second and fourth electrical contacts, together.

An electrical conductor 320 has a first end 321 which is electrically connected with the third electrical contact 316 of the first solenoid mechanism 310, and a second end 322 which is electrically connected with the engine 261 of the second fan assembly 260. An electrical conductor 323 further has a first end 324 which is electrically connected with the fourth electrical contact 317 of the first solenoid mechanism 310 and a second end 325 which is also electrically connected to the engine 261 of the second fan assembly. The first thermostat 302, the solenoid mechanism 310; and the various electrical conductors 305, 307, 308, 311, 312, 320, and 323 comprise a first electrical path 326 which is adapted to provide electrical energy selectively to the second fan assembly thereby actuating it when outside ambient air temperatures require it. As earlier discussed the first thermostat is operable, when the outside ambient air temperature reaches or exceeds 78° Fahrenheit to actuate the second fan assembly thereby causing it to draw a predetermined volume of air through the second auxiliary coil 240 for the purpose of absorbing and dissipating heat energy from the refrigerant coursing therethrough and consequently increasing the efficiency of the heat pump 11 when the outside ambient air temperature would otherwise have not permitted efficient heat pump operation. As should be understood the increased surface area to volume of refrigerant ratio of the second auxiliary coil 240 permits increased amounts of heat energy to be extracted or otherwise removed from the refrigerant when the second fan assembly is rendered operational.

The apparatus 10 of the subject invention mounts a second thermostat generally indicated by the numeral 330. The second thermostat, which is of conventional design, is mounted to the front wall 25 of the housing 12 in the second housing 31 and is adapted to sense the environmental ambient air temperature. The second thermostat mounts a contact bridge 331 which is operable to move from an open to a closed electrical condition between a first and second electrical contact 332 and 333, respectively. An electrical conductor 334 is attached in electrically conductive relation to the source of 24 volt power 300, and to the first electrical contact 332, and electrical conductors 335 and 336 are electrically connectd to a second solenoid mechanism which is generally indicated by the numeral 340. The electrical conductors 335 and 336 individually interconnect the second solenoid mechanism to the second electrical contact 333; and to the source of 24 volt power, respectively. The second solenoid mechanism is substantially identical to the first solenoid mechanism 310, that is, it has first, second, third and fourth electrical contacts 341, 342, 343, and 344, respectively, and a pair of contact bridges 345 are individually mounted to the first and second electrical contacts 341 and 342, and are operable to be moved, by the second solenoid mechanism, between an open and closed electrical state with the third and fourth electrical contacts 343 and 344, respectively.

An electrical conductor 350 is connected in electrically transmitting relation with the source of 110 voltage 301, and with the first electrical contact 341 of the second solenoid mechanism 340. A second electrical conductor 351 is also mounted in electrically conducting relation with the source of 110 voltage and with the second electrical contact 342 of the same solenoid mechanism. A first temperature control, which is generally indicated by the numeral 353 is mounted to the second support wall 50 in the second space 53. The first temperature control has first, second, third and fourth electrical contacts 354, 355, 356 and 357, respectively, and further mounts a pair of contact bridges 362 which are individually mounted to the first and second electrical contacts 354 and 355, respectively. As should be understood the first temperature control is operable to move the pair of contact bridges from an open electrical state to a closed electrical state at a predetermined temperature. In this instance, the first temperature control is electrically connected to the second solenoid mechanism, by an electrical conductor 363, which has a first end 364 that is electrically connected to the third electrical contact 343, and a second end 365 that is electrically connected to the first electrical contact 354. Furthermore, an electrical conductor 370 having a first end 371 which is connected to the fourth electrical contact 344 of the second solenoid mechanism and a second end 372, that is connected to the second electrical contact 355, also serves electrically to connect the first temperature control to the second solenoid mechanism.

An electrical conductor 380 has a first end 381 which is electrically connected to the third electrical contact 360 of the first temperature control 353 and a second end 382 which is connected to the second quartz heater 251. Further, an electrical conductor 383 has a first end 384 which is connected to a fourth electrical contact 361, and a second end 385 which is connected to the second quartz heater. An electrical conductor 386 extends between the temperature sensor 271 and the first temperature control 353, and has a first end 387 which is electrically connected to the first temperature control and a second end 388 which is electrically connected to the temperature sensor 271. As should be understood, the first temperature control 353 is operable to move the contact bridges into an electrically closed position when the temperature sensor detects that the refrigerant coursing through the tenth conduit 264 is at a temperature at or below 32° Fahrenheit. When this occurs, the electrical conductors 383 and 380 are operable to supply electricity to the second quartz heater. The significance of this feature of the invention will hereinafter be discussed in greater detail.

A second temperature control 390 is mounted to the first support wall 45 and is disposed in the second space 53 of the housing 12. The second temperature control, which is substantially identical to the first temperature control 353 in overall design and function, has first, second, third and fourth electrical contacts 391, 392, 393 and 394, respectively, and a pair of contact bridges 395 are individually mounted to the first and second contacts 391 and 392 and are operable to be moved from an open electrical state to a closed electrical state thereby electrically connecting the first and third electrical contacts and the second and fourth electrical contacts, respectively, together. An electrical conductor 400 has a first end 401 which is electrically connected to the first electrical contact 354, and a second end 402 that is electrically connected to the third electrical contact 393. Further, an electrical conductor 403 has a first end 404, which is electrically connected to the second electrical contact 355, and a second end 405 which is affixed to the fourth electrical contact 394. An electrical conductor 410 has a first end 411 which is electrically connected to the first quartz heater 191, and a second end 412 which is electrically connected to the first electrical contact 391. Another electrical conductor 413 has a first end 414 which is electrically connected to the first quartz heater 191 and a second end 415 which is affixed to the second electrical contact 392. An electrical conductor 420 has a first end 421 which is connected electrically to the second temperature control 390, and a second end 422 which is affixed to the temperature sensor 172. The second temperature control is operable upon sensing that the refrigerant coursing through the fifth conduit is at or below 40° Fahrenheit to move the pair of contact bridges into the closed electrical state. Conversely, the second temperature control operates to open the contact bridges when the temperature of the refrigerant rises above 40° Fahrenheit.

Figure 3:
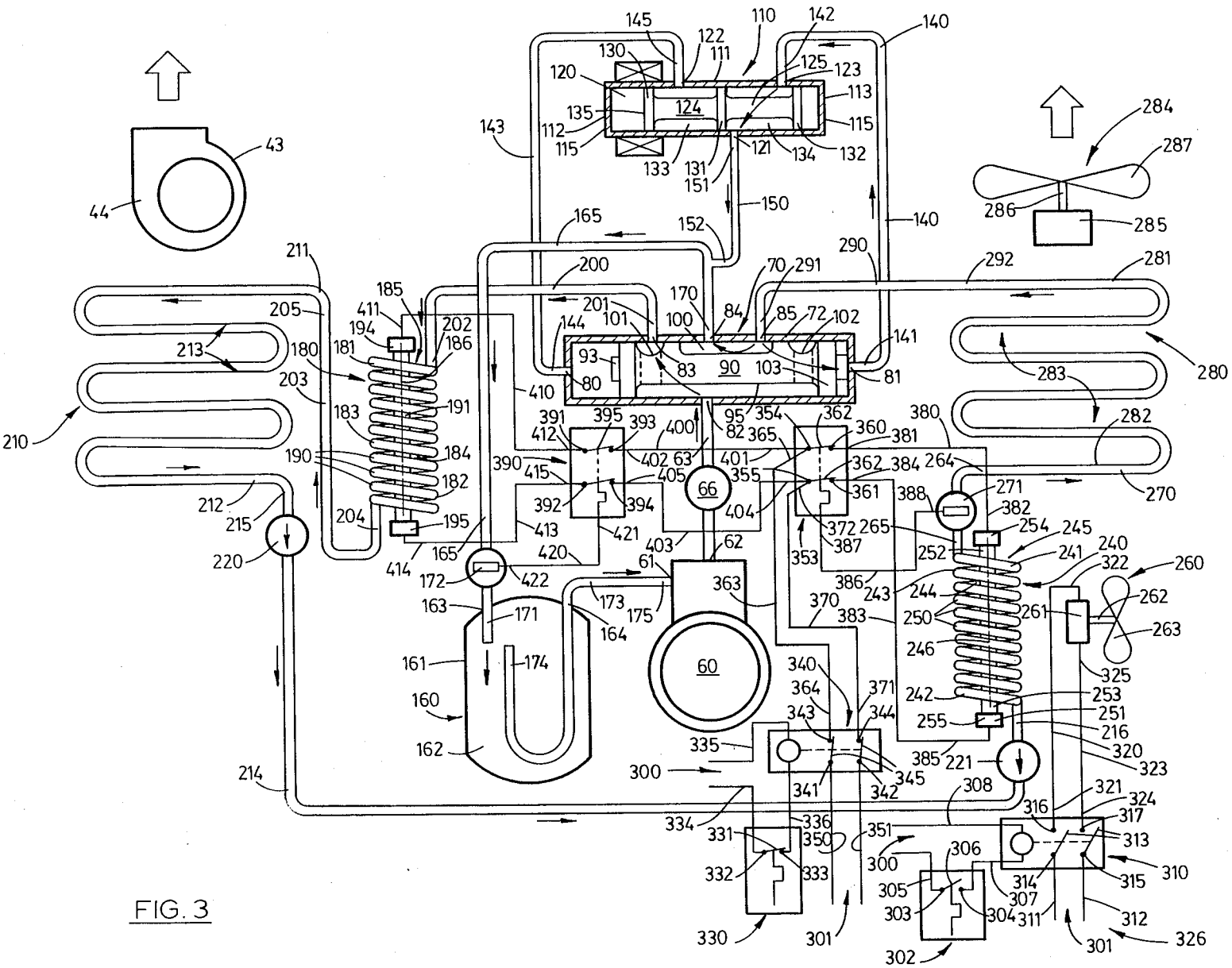
FIG. 3 is a schematic diagram of the apparatus of the subject invention and showing the heating cycle thereof.
Figure 4:
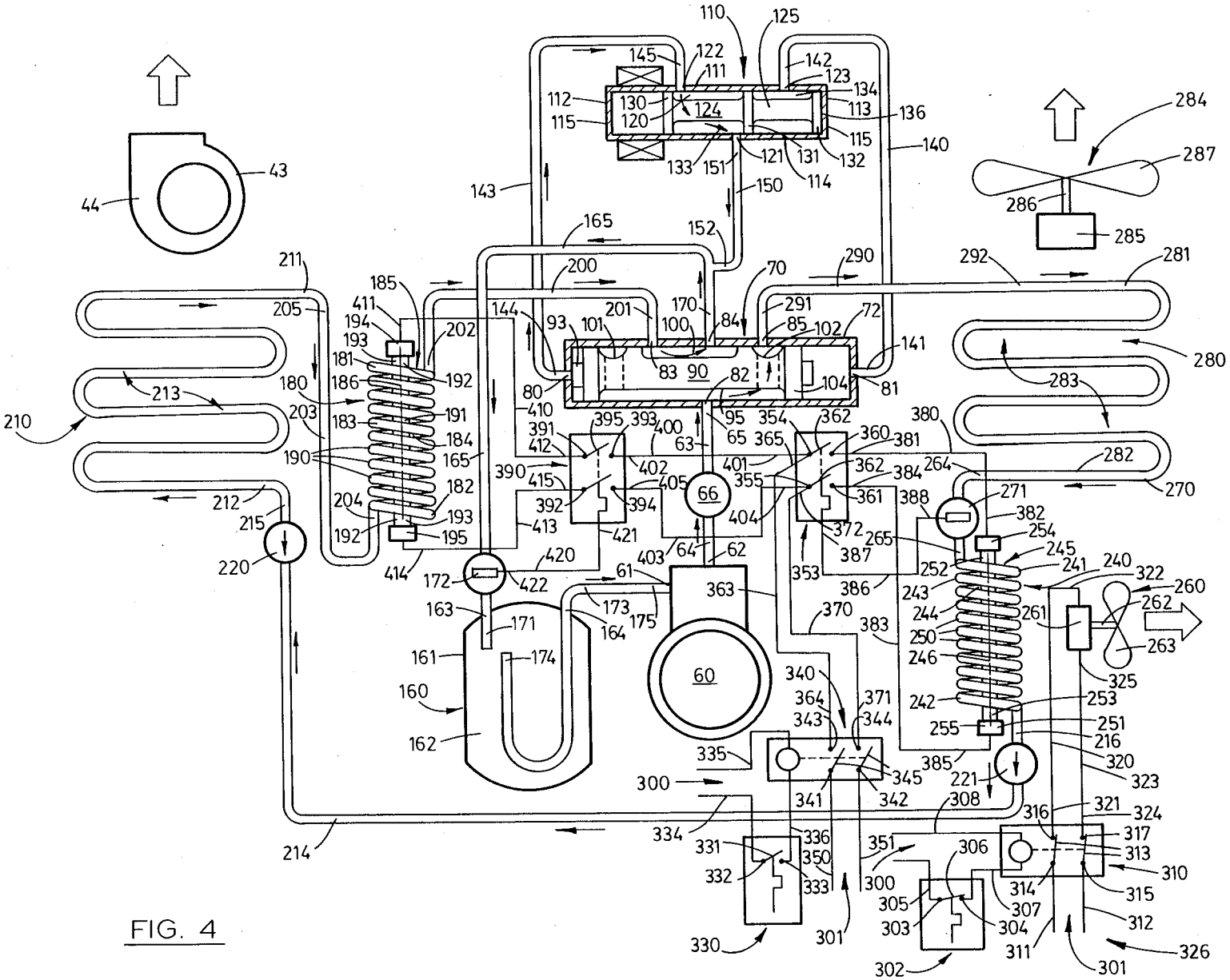
FIG. 4 is a schematic diagram of the apparatus of the subject invention and showing the cooling cycle thereof.
Figure 5:
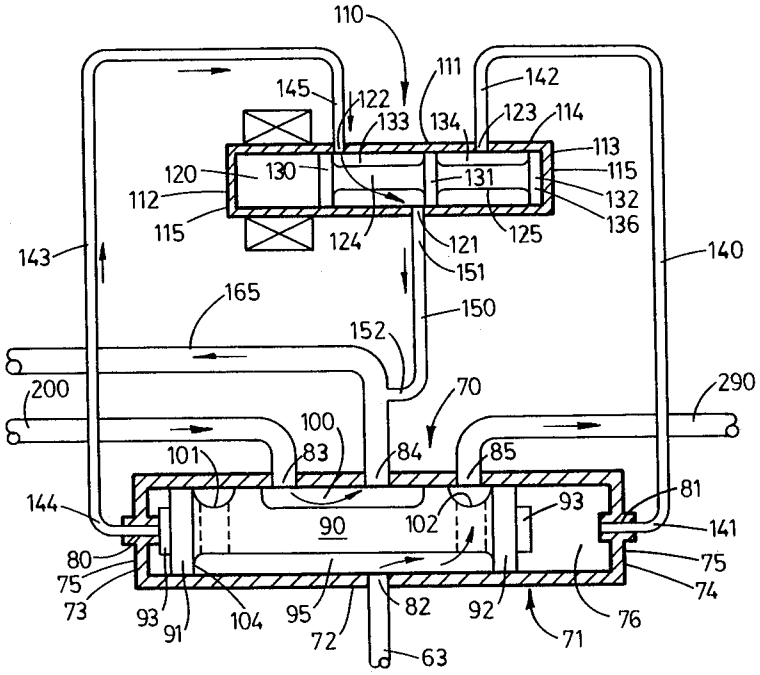
FIG. 5 is a somewhat further enlarged longitudinal section of the four-way reversing valve of the subject invention shown during the heating cycle.

As should be understood the function of the heat pump 11, as shown and described herein is substantially identical to other similar prior art devices which are designed for essentially identical purposes that is, the heat pump 11 has a heating cycle which is generally indicated by the refrigerant circulation pattern shown in FIGS. 3 and 5 and a cooling or defrost cycle which is indicated most clearly by a study of the refrigerant circulation pattern shown in FIG. 4. Further, the direction of flow of the refrigerant along the various refrigerant transmitting conduits and through the assorted subassemblies previously discussed is indicated by the numerous arrows placed therealong these items unless otherwise indicated to the contrary.

Referring more particularly to the heating cycle of the heat pump 11 as most clearly shown in FIGS. 3 and 5, when the remote thermostat disposed in the conditioned space, not shown, becomes actuated it in turn causes the solenoid pilot valve 110 to move to the first or energized position 135. In the energized position, the slide 124 is positioned to close off the second port 122 and to open the first and third ports 121 and 123, respectively. Furthermore, when the solenoid pilot valve assumes the energized position, the first nose valve 80 is isolated from the suction side of the heat pump by the solenoid pilot valve and the second nose valve 81 is exposed to suction side pressure through the solenoid pilot valve by the conduits 140 and 150, respectively. When this event occurs, the piston 90 of the four-way valve 70 moves to the first position 103. In the first position 103, the piston 90 is operable to direct the refrigerant from the outside coil 280 to the accumulator and thence into the compressor 60. Upon reaching the compressor, the refrigerant is compressed to a high pressure, high temperature gas and is thereafter diverted by the piston 90 to the indoor coil 210. The compressed gas, of course, travels through the first auxiliary coil 180 on its way to the indoor coil.

Upon reaching the indoor coil 210, the indoor coil acts as a condenser, that is, the air from the conditioned space passing over the indoor coil, picks up or absorbs heat from the refrigerant. The refrigerant, after losing this heat energy is changed from a high temperature, high pressure gas, to a high temperature, high pressure liquid. Upon leaving the indoor coil 210, the liquid refrigerant passes virtually unimpeded through the first metering check valve 220 and travels along the ninth conduit 214 to the second metering check valve 221. As should be understood the second metering check valve and more particularly the gate 232 thereof moves to, and remains positioned in the fluid impeding position 235 when exposed to the refrigerant circulation pattern as shown in FIG. 3. As earlier discussed, when the gate is disposed in the fluid impeding position 235 the gate operates as an expansion device. After passing through the gate 235, the liquid refrigerant is metered and reduced by the gate from a high pressure, high temperature liquid to a low pressure, low temperature liquid. Following the passage of the refrigerant through the second metering check valve the refrigerant enters into the outdoor coil 280 which acts as an evaporating coil. As should be understood outside air passing over the outside coil gives up heat to the refrigerant, and thus boils or evaporates the low pressure, low temperature liquid and changes it to a low pressure, low temperature gas. The low temperature and low pressure gas is then drawn back through the four-way valve 70 and to the compressor 60 to start the cycle again.

As discussed earlier in the specification, when the outside ambient air temperature reaches certain predetermined minimums and maximums, the efficiency of the heat pump 11 significantly decreases. As shown and described herein, the apparatus 10 is operable to enhance the operational capabilities of the heat pump 11 during those time periods when the outside ambient air temperature would not be conductive to efficient heat pump operation. More specifically, the apparatus 10 is operable, when the outside ambient air temperature approaches approximately 38° Fahrenheit to activate. As should be understood, the second thermostat 330 is adapted to close the contact bridge 331 at approximately 38° Fahrenheit, the closing of the contact bridge permitting the source of 24 volt power 300 to be provided to the second solenoid mechanism 340, through electrical conduits 334, 335, and 336, respectively. When this event occurs, the second solenoid mechanism is operable electrically to close the pair of contact bridges 345 thereby allowing 110 volt power 301 to travel along electrical conductors 350, 351, 363, 370, 400 and 403. The second temperature control 390 is adapted to sense the temperature of the refrigerant coursing through the fifth conduit 165, and if the temperature of the refrigerant rises above 40° Fahrenheit, the second temperature control 90 is adapted to open the pair of contact bridges 395. For purposes of this discussion, it should be assumed that the present temperature of the refrigerant is below 40° Fahrenheit and therefore the pair of contact bridges 395 are electrically closed. Assuming this is the case, the 110 volt power continues to travel across the contact bridges 395 and onto electrical conductors 410 and 413 and into the first quartz heater 191 where it energizes it thereby producing radiant heat energy which efficiently heats the first auxiliary coil 180 and the refrigerant coursing therethrough.

As the refrigerant, during the heating cycle, passes into the indoor coil 210, the air from the conditioned space passing over the indoor coil picks up or absorbs heat from the refrigerant, and as a consequence the refrigerant changes states. It should be appreciated, therefore, that for heat to flow out of the refrigerant the heat content of the refrigerant, as manifested by its temperature, must be greater than the air passing over the indoor coil. When the environmental ambient air temperatures are low, for example at or below 38° Fahrenheit insufficient heat has been extracted from the ambient air by the outside coil 280 and therefore the first auxiliary coil 180 is provided to increase the heat content of the refrigerant before it reaches the indoor coil 210. As earlier discussed, the first auxiliary coil has an increased surface area to volume of refrigerant ratio, and the first quartz heater 191 is operable to impart heat energy to the first auxiliary coil such that the refrigerants temperature is raised to a level whereby heat will flow out of the refrigerant and to the air of the conditioned space. After the heating cycle has been in operation for a period of time, the temperature of the refrigerant will eventually rise. When the refrigerant temperature reaches a temperature at or above 40° Fahrenheit the second temperature control 390 is adapted to open the pair of contact bridges 395 thereby terminating the supply of 110 power 301 to the first quartz heater 191.

During certain periods of the year, the environmental ambient air temperature may be so low that a heat pump 11 may be rendered very inefficient, for example, when the temperatures approach freezing, 32° Fahrenheit or below. Moreover, when these low temperatures are experienced problems related to the operation of the outside coil 280 develop. As should be understood, the outdoor coil is operable, during the heating cycle, to remove or absorb heat from the environmental ambient air, that is, the outside coil acts as an evaporator and the ambient air passing over the outside coil gives up heat to the refrigerant passing therethrough. The refrigerant, which absorbs this heat, subsequently boils and thereafter changes states from a low pressure, low temperature liquid to a low pressure, low temperature gas. In order for heat to flow into the refrigerant, the refrigerant temperature must be lower than the outside ambient air temperature. In this scenario, the outside coil may be many degrees below freezing and as a result moisture in the air will condense on the outside coil causing frost and ice to block the coil and therefore diminish its operational capability. To remedy this situation and further to impart heat energy to the refrigerant, the second auxiliary coil 240 is provided. As earlier discussed, the second quartz heater 251 is electrically connected to the first temperature control 353, and is operable to sense the temperature of the refrigerant which is passing through the tenth conduit 264. When the temperature of the refrigerant drops to a temperature at or below 32° Fahrenheit the first temperature control is operable to close the pair of contact bridges 362 thereby permitting 110 volt power 301 to travel along the electrical conductors 363 and 370 to the electrical conductors 380 and 383, respectively. When this event occurs, the second quartz heater 251 becomes energized thereby producing radiant heat energy which heats the second auxiliary coil 240 and the refrigerant resident therein. The addition of heat energy to the refrigerant has the effect of warming the outside soil thereby inhibiting the formation of ice and frost on the outside coil, and thus enhances the operation of the heat pump 11 when it operates at extremely low temperatures. Further, this heat energy augments the heat energy imparted to the refrigerant moving through the first auxiliary coil 180 thereby allowing increased heat energy to be transmitted through the refrigerant to the indoor coil 210. Of course, when the temperature of the refrigerant rises above 32° Fahrenheit, the first temperature control 353 is operable to open the pair of contact bridges 362 thereby deactivating the quartz heater 251 of the second auxiliary coil. As should be understood when the environmental ambient air temperature rises above 38° Fahrenheit the second thermostat 330 opens the contact bridge 331 and renders both the first and second quartz heater inoperative.

Figure 6:
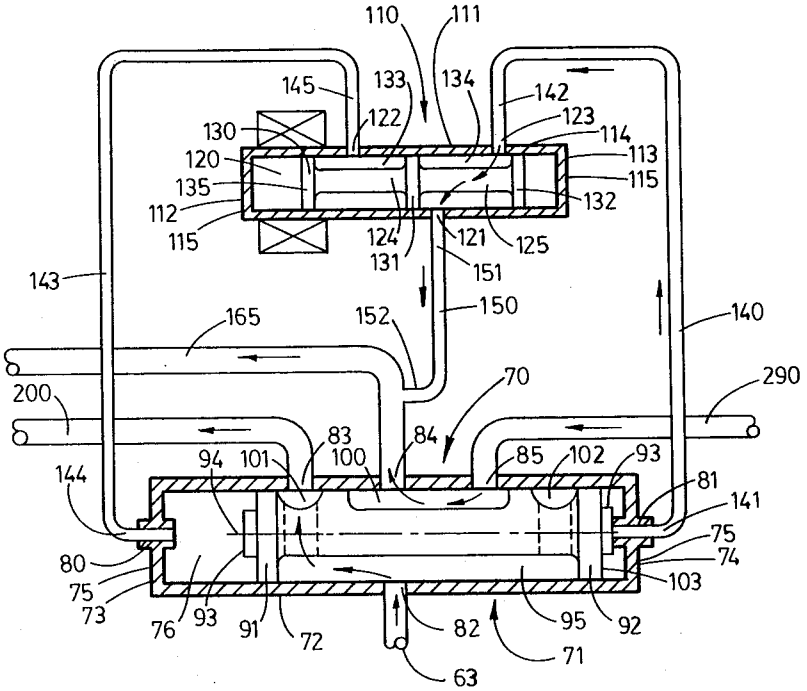
FIG. 6 is a somewhat enlarged fragmentary longitudinal section of the four-way reversing valve of the subject invention shown during the cooling cycle.

The operation of the cooling cycle of the heat pump 11 is best understood by a study of the refrigerant circulation pattern, as shown in FIGS. 4 and 6. The refrigerant circulation pattern is indicated by the numerous arrows which are placed alongside the various refrigerant conduits. The arrows indicate the direction of movement of the refrigerant unless otherwise indicated to the contrary. To initiate the cooling cycle, the solenoid pilot valve 110 is deenergized and the slide 124 is operable to move under the urging of a biasing spring (not shown), to the second or deenergized position 136 wherein it closes the third port 123, and opens the first and second ports 121 and 122, respectively. In this deenergized position the discharge pressure imposed in the vicinity of the first nose valve 80 will bleed off through the solenoid pilot valve via the third conduit 143, the first flow area 133 and through the fourth conduit 150, to the suction side of the heat pump 11. The unbalanced pressure at the first and second ends 91 and 92 of the piston 90 keeps the piston in the second position 104.

In the second position 104 the piston 90 is operable to divert the refrigerant along the circulation pattern indicated in FIGS. 4 and 6. As should be understood, when the heat pump 11 is operating during the cooling cycle, discharged refrigerant gas leaving the compressor 60 through the first conduit 63 enters in through the first port 82 and is diverted by the piston 90 through the fourth port 85 and into the eleventh conduit 290. Upon entering the eleventh conduit 290 the refrigerant travels to the outside soil 280, the outside coil in this situation acting as a condenser, that is, environmental ambient air passing over the outside coil picks up or absorbs heat from the refrigerant resident therein and thereby changes it from a high temperature, high pressure gas, to a high temperature, high pressure liquid. Upon leaving the outside coil through the tenth conduit 264, the refrigerant passes through the second auxiliary coil 240, and thence passes substantially unimpeded through the second metering check valve 221 and along the ninth conduit 214. The refrigerant thereafter encounters the first metering check valve 220. As should be understood the gate 232 moves to, and remains positioned in, the fluid impeding position 235 when it is exposed to the refrigerant circulation pattern as shown in FIG. 4. As earlier discussed, in the fluid impeding position 235, the gate 232 and the orifice 234 formed therein, operates as an expansion device which causes the liquid refrigerant to be metered, and reduced, from a high pressure, high temperature liquid to low pressure, low temperature liquid. After the refrigerant has passed through the gate, it travels to the indoor coil 210, which acts, in this situation as an evaporator, that is, the air from the conditioned spaced passing over the inside coil gives up heat energy to the refrigerant. The heat energy given up to the refrigerant causes the refrigerant to boil or evaporate thereby changing it from a low pressure, low temperature liquid to a low pressure, low temperature gas. The refrigerant is thereafter drawn back through the eighth conduit 203, the first auxiliary coil 180, conduits 200, 165 and 173 and back to the compressor 60 where the cycle begins again.

When the outside ambient air reaches temperatures above 78° Fahrenheit, the heat pump 11 becomes increasingly inefficient because there is insufficient temperature differential between the temperature of the refrigerant and the temperature of the air to be conditioned. As should be understood, in order for heat to leave the air of the conditioned space and enter the refrigerant which is passing through the indoor coil 210 the refrigerant temperature must be lower than the conditioned spaces air temperature. To enhance the performance of the heat pump 11 during those periods wherein the environmental ambient air temperatures reach or exceed 78° Fahrenheit, the second fan assembly 260 is provided. As should be appreciated, the first thermostat 302 is operable, when the ambient air temperature reaches or exceeds 78° Fahrenheit to close the contact bridge 306 thereby permitting 24 volt power to travel along electrical conductors 305, 307, and 308 and energize the first solenoid mechanism 310. When energized, the first solenoid mechanism is operable electrically to close the pair of contact bridges 313 thereby permitting 110 volt power 301 to travel along the electrical conductors 311, 312, 320, and 323 and be received at the engine 261 of the second fan assembly. When this event occurs, the fan assembly is operable to move a predetermined amount of environmental ambient air through the second auxiliary coil 240 for purposes of absorbing heat energy from the refrigerant coursing therethrough. The loss of heat energy, of course, lowers the refrigerant's temperature thereby enhancing the performance of the heat pump. As earlier discussed, the second auxiliary coil has an increased surface area to volume of refrigerant ratio, and therefore, the second fan assembly provides an efficient means for absorbing heat energy from the refrigerant further to extend the operational capabilities of the heat pump when the elevated environmental ambient air temperature would have substantially inhibited such performance. It should be understood that the first thermostat is operable to deenergize the first solenoid mechanism when the outside ambient air temperature falls below 78° Fahrenheit.

OPERATION

The operation of the described embodiment of the present invention is believed readily apparent and is briefly summarized at this point.

The apparatus 10 which is operable to enhance the performance of a heat pump 11, has first and second auxiliary coils 180 and 240, respectively, which are mounted in fluid flow relation at predetermined positions in the heat pump. Each auxiliary coil further has an individual quartz heater 191 and 251, respectively, which are operable selectively to impart radiant energy to the respective coils for purposes of elevating the temperature of the refrigerant coursing therethrough, at preselected environmental ambient air temperatures. The apparatus 10 has a second thermostat 330 which is electrically interconnected with a first and second temperature control 353 and 390, respectively. When the environmental ambient air temperature falls below 38° Fahrenheit, the second thermostat is operable to permit 110 volt power 301 to travel to each of the temperature controls. Each temperature control, in turn, is adapted, at a predetermined refrigerant temperature to meter this 110 volt electricity to the first and second quartz heaters 191 and 251, respectively.

As earlier discussed, when the temperature of the refrigerant falls below 40° Fahrenheit, the second temperature control 390 is operable to create a closed electrical condition whereby 110 volt power 301 reaches the first quartz heater 191 thereby energizing it. The quartz heater in turn, is operable to heat the refrigerant coursing through the first auxiliary coil 180 thereby raising its temperature with the attendant benefits earlier discussed. Further when the temperature of the refrigerant falls below 32° Fahrenheit, the first temperature control 353 is operable to create a closed electrical state whereby 110 volt power is supplied to the second quartz heater 251. The second quartz heater, of course, heats the second auxiliary coil 240 thereby causing the temperature of the refrigerant coursing therethrough to become elevated. Lastly, when the environmental air temperature reaches or exceeds 78° Fahrenheit, the first thermostat 302 is operable to permit 110 volt power to be supplied to the second fan assembly 260 thereby energizing it, the second fan assembly operable to draw air through the second auxiliary coil to 240 cool it, and the refrigerant passing therethrough. The second fan assembly ia adapted to extend the operational range of the heat pump 11 when it is operated during periods of elevated temperature.

Therefore, it will be seen that the apparatus 10 for enhancing the performance of a heat pump 11 provides a fully dependable and practical means for producing conditioned air which has preselected temperature parameters during periods of environmental ambient air temperatures which have heretofore inhibited efficient heat pump operation, and which further reduces to an absolute minimum the possibility of inhibited heat pump operation which would be attributed to the formation of ice or frost on the outside oil 280 during periods of extremely low environmental temperatures, and which is both of sturdy and dependable construction and is relatively inexpensive to manufacture and maintain.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for enhancing the performance of a heat pump that utilizes a refrigerant, the apparatus comprising first and second auxiliary coils of predetermined dimension operatively interconnected in fluid flow relation with the heat pump to receive and transmit the refrigerant;

radiant heating means disposed in heat transferring relation to the first and second auxiliary coils for imparting heat energy to the refrigerant therein;

temperature sensor means operatively interconnected with the heat pump for sensing the temperature of the refrigerant and the ambient air temperature;

air flow inducing means disposed in heat removing relation to the second auxiliary coil for dissipating the heat energy from the refrigerant contained therein; and selectively adjustable control means for selectively actuating the radiant heating means of the first and second auxiliary coils, and the air flow reducing means for selected periods of time at a predetermined high and low ambient air temperature, and predetermined refrigerant temperatures to achieve increased heat pump efficiency.

2. The apparatus of claim 1 wherein the radiant heating means is a quartz heating element which is disposed substantially centrally and internally of the first and second auxiliary coils and the air flow inducing means is a fan adapted to move a predetermined volume of ambient air through the second auxiliary coil.

3. The apparatus of claim 2 wherein the first and second auxiliary coils have a high surface area to volume of refrigerant ratio and the selectively adjustable control means is a thermostat which selectively actuates the quartz heater of the first auxiliary coil at an outside ambient air temperature below substantially 38° Fahrenheit, and the quartz heater of the second auxiliary coil at a refrigerant temperature of 32° Fahrenheit, the control means further actuating the fan at an outside ambient temperature above substantially 78° Fahrenheit.

4. The apparatus of claim 3 wherein the heat pump mounts a temperature control which is electrically connected to the thermostat and which is operable to sense the temperature of the refrigerant and is adapted to deactivate the quartz heater of the first auxiliary coil when the refrigerant temperature reaches or exceeds a temperature of substantially 40° Fahrenheit.

5. The apparatus of claim 1 wherein at least one metering check valve is operatively connected in fluid transferring relation with the heat pump and is disposed between the first and second auxiliary coils, the metering check valve having a gate which permits the free flow of refrigerant in a first direction, and is adapted substantially to restrict the flow of refrigerant in a second direction and the gate having a restricted diameter orifice formed therein and acting as an expansion device when refrigerant travels in the second direction.

6. The apparatus of claim 4 wherein the heat pump mounts a second temperature control which is electrically connected to the thermostat and which is adapted selectively to actuate the quartz heating element of the second auxiliary coil when the refrigerant temperature reaches or proceeds below substantially 32° Fahrenheit.

7. The apparatus of claim 3 wherein the control means mounts a second thermostat which is operable to actuate the fan when the outside ambient air temperature reaches or exceeds substantially 78° Fahrenheit.

8. An apparatus for enhancing the performance of a heat pump that has a compressor, an evaporator, a condenser, a refrigerant, and conduits for serially connecting and transmitting the refrigerant between the compressor, evaporator, and condenser, the apparatus comprising:

a first auxiliary coil having a longitudinal axis and operatively connected in fluid communication with and upstream of the condenser and downstream of the compressor, said first auxiliary coil being a reduced diameter helical coil having an increased surface area to volume of refrigerant ratio;

a second auxiliary coil having a longitudinal axis and operatively connected in fluid communication with and downstream of the condenser and upstream of the evaporator, said second auxiliary coil being a reduced diameter helical coil having an increased surface area to volume of refrigerant ratio;

at least one radiant quartz heating element disposed in radiant heat transferring relation internally and substantially centrally along the longitudinal axis of each auxiliary coil, the quartz heating element adapted to impart heat energy to the refrigerant as it circulates in each auxiliary coil;

a fan mounted in heat removing relation externally of the second auxiliary coil, said fan drawing a volume of air through the second auxiliary coil to absorb and thereby dissipate heat energy from the refrigerant; and temperature control means operatively connected to each quartz heating element and to the fan for individually selectively activating each quartz heating element and the fan for predetermined periods of time at individual selected high and low ambient air temperatures and high and low refrigerant temperatures to achieve enhanced heat pump efficiency.

9. The apparatus of claim 8 wherein the thermostatic control means has first and second thermostats and first and second temperature controls and an electrical path operably connects the first thermostat to the fan, and a second electrical path operably connects the second thermostat with each temperature control and with each radiant quartz heater.

10. The apparatus of claim 9 wherein the second thermostat is operable to energize the radiant quartz heater which is disposed in heat transferring relation to the first auxiliary coil when the outside ambient temperature reaches or proceeds below substantially 38° Fahrenheit and the second temperature control is adapted to sense the temperature of the refrigerant at a predetermined location in the heat pump and is operable to deenergize the same radiant quartz heating element when the temperature of the refrigerant reaches or exceeds substantially 40° Fahrenheit.

11. The apparatus of claim 10 wherein the first temperature control is adapted to sense the temperature of the refrigerant at a predetermined location in the heat pump and is operable to energize the radiant quartz heating element which is disposed in radiant heat transferring relation to the second auxiliary coil when the temperature of the refrigerant reaches or proceeds below a temperature of substantially 32° Fahrenheit.

12. The apparatus of claim 11 wherein the second temperature control mechanism measures the temperature of the refrigerant at a location downstream of the evaporator and upstream of the compressor; and the first temperature control measures the temperature of the refrigerant at a location downstream of the second auxiliary coil and upstream of the evaporator.

13. The apparatus of claim 8 wherein first and second metering check valves are disposed in fluid metering relation along the conduit which connects in fluid flow relation the evaporator with the condenser, each metering check valve having a gate which permits the free flow of refrigerant in one direction of travel and meters the flow of refrigerant in the opposite direction of travel, each gate having a reduced diameter orifice formed therein.

14. The apparatus of claim 13 wherein the heat pump has a heating and cooling cycle of operation, and the first metering check valve is disposed in metering relation to the refrigerant when the heat pump is in the cooling cycle and the second metering check valve is disposed in metering relation to the refrigerant when the heat pump is in the heating cycle.

15. An apparatus for enhancing the performance of a heat pump that has a compressor, an evaporator, a condenser, a refrigerant, and conduits for serially connecting and transmitting the refrigerant between the compressor, evaporator and condenser, the apparatus comprising at least one auxiliary coil having a longitudinal axis and operatively interconnected in fluid communication with and downstream of the evaporator and upstream of the compressor, said auxiliary coil being a reduced diameter helical coil having an increased surface area to volume of refrigerant ratio; at least one radiant quartz heating element disposed in radiant heat transferring relation internally, and substantially centrally along said longitudinal axis of the auxiliary coil, the quartz heating element adapted to impart heat energy to the refrigerant as it circulates in the auxiliary coil; a fan mounted in heat removing relation externally of the auxiliary coil, said fan drawing a volume of air through the auxiliary coil to absorb and thereby dissipate heat energy from the refrigerant; and thermostatic control means operatively connected to the quartz heating element and the fan for individually selectively activating the quartz heating element and the fan for predetermined periods of time at individual selected high and low ambient air temperatures to achieve enhanced heat pump efficiency.

16. The apparatus of claim 15 wherein the quartz heating elements are actuated at an outside ambient temperature below 36° Fahrenheit and the fan is actuated at an outside ambient air temperature above 78° Fahrenheit.

* * * * *